United States Patent [19]

Markowski et al.

[11] Patent Number: 4,675,481

[45] Date of Patent: Jun. 23, 1987

[54] COMPACT ELECTRIC SAFETY SWITCH

[75] Inventors: Robert G. Markowski, East Haven; Stanley M. Balcezak, Jr., Windsor; John J. Bottalico, Newington; John A. Morby, Farmington; Robert J. Sabatella, Southington, all of Conn.

[73] Assignee: General Electric Company, New York, N.Y.

[21] Appl. No.: 917,326

[22] Filed: Oct. 9, 1986

[51] Int. Cl.[4] ..... H01H 33/08; H01H 33/42

[52] U.S. Cl. ..... 200/144 R; 200/67 A; 200/148 H

[58] Field of Search ..... 200/144 R, 146 R, 148 H, 200/150 C, 67 A

[56] References Cited

U.S. PATENT DOCUMENTS

| | | | |
|---|---|---|---|
| Re. 18,385 | 3/1932 | Gaynor | 200/67 A |
| 1,440,467 | 1/1923 | Jennings | 200/67 A |
| 1,911,072 | 5/1933 | Dyer et al. | 200/150 C |
| 2,188,780 | 1/1940 | Sambleson et al. | 200/67 A |
| 4,201,439 | 5/1980 | M'Sadoques | 339/259 |
| 4,233,482 | 11/1980 | DiMarco et al. | 200/163 |
| 4,596,911 | 6/1986 | Guery et al. | 200/146 R |

OTHER PUBLICATIONS

U.S. patent application Ser. No. 811,716, filed Dec. 20, 1985, entitled "Molded Plastic Enclosure for Disconnect Switches" in the names of David Alan Hibbert et al.

*Primary Examiner*—Robert S. Macon

*Attorney, Agent, or Firm*—Richard A. Menelly; Walter C. Bernkopf; Fred Jacob

[57] ABSTRACT

A compact electric safety switch including a rotatably mounted double contact assembly. Heavy duty compression springs are positioned under the blade assembly for rapid make and break connection between a pair of contact stabs. The series arrangement between the pair of contact stabs generates a corresponding pair of electrical arcs during the make and break occurrence which is less intense and of shorter duration than standard single contact arrangements. The pair of less intense arcs of short duration allow for a corresponding pair of arc chutes of smaller size than standard single arc chute arrangements. The contact stabs that receive the double contact blade are staggered to reduce electromagnetic attraction between the contact and the stabs.

16 Claims, 10 Drawing Figures

"ON"

"OFF"

COMPACT ELECTRIC SAFETY SWITCH

BACKGROUND OF THE INVENTION

The electrically insulative properties of thermally stable plastic materials multi-functionally houses and insulates the electrical components contained therein for electrical switching applications. The impact resistance of the plastic material facilitates mounting the movable components within the plastic enclosure without fear of damage caused by the violent arcs that occur when the switch contacts are connected and disconnected while carrying current. Suitable plastic materials for the switch enclosure are "Valox", a registered trademark of General Electric Company for polybutylene terepthalate and "Noryl", a trademark of General Electric Company for a modified polyphenylene oxide. One such molded plastic enclosure for electrical disconnect switches is described within U.S. patent application Ser. No. 811,716, filed Dec. 20, 1985, which Application is incorporated herein for reference purposes.

It is understood that electric arcs will form between a pair of electric contacts when the current through the contacts is interrupted and some arc chute means is required to cool and quench the electric arc. The larger the current during interruption, the more intense the arc and, hence, the larger the arc chute required. The duration of the arc is also related to the time involved in moving the electric contacts to a sufficient distance such that the arc voltage necessary to maintain the arc is greater than the available systems voltage.

An early attempt to rapidly make and break electrical connection between a pair of separable contacts is found in U.S. Pat. No. 4,233,482, wherein the movable contact carrier engages an over-center spring to rapidly accelerate the opening and closing forces applied during manual operation of the movable contact carrier. This Patent describes a single pair of separable contacts for each phase of the current and, hence, requires a single sizable arc chute configuration.

The electric switch arrangement of the instant arrangement uniquely employs a double ended Z-shaped contact blade mounted on a rotary contact carrier for connecting and disconnecting the contacts between a pair of contact blades on opposite sides of the Z-shaped contact blade. The blades comprise a U-shaped configuration wherein one leg of the U is shorter than the other to create an extended magnetic air gap. The reduction in electromagnetic forces acting upon the Z-shaped contact blade and the contact stabs is thereby reduced to promote rapid separation between the Z-shaped contact blades and the U-shaped contact stabs.

SUMMARY OF THE INVENTION

An electrical disconnect switch employs a split-cylinder as a rotary mounted contact blade carrier with a pair of U-shaped contact stabs arranged on opposite ends. Overcenter springs subjacent the contact carrier rapidly accelerate the contact blades into their open and closed contact positions. The split-cylinder includes a predetermined lost motion space whereby the contact carrier moves over center to charge the overcenter springs prior to separating the contact blades from the contact stabs. A T-shaped mechanical actuator connects the manually operated handle with the contact carrier to provide further lost motion between the contact carrier and the contact blades. A pair of opposedly arranged U-shaped arc chutes are mounted on the electric disconnect switch base and cover to rapidly extinguish the pair of electric arcs that occur upon connection and disconnection between the contact blades and the contact stabs.

DESCRIPTION OF THE PREFERRED EMBODIMENT

Figure 1:
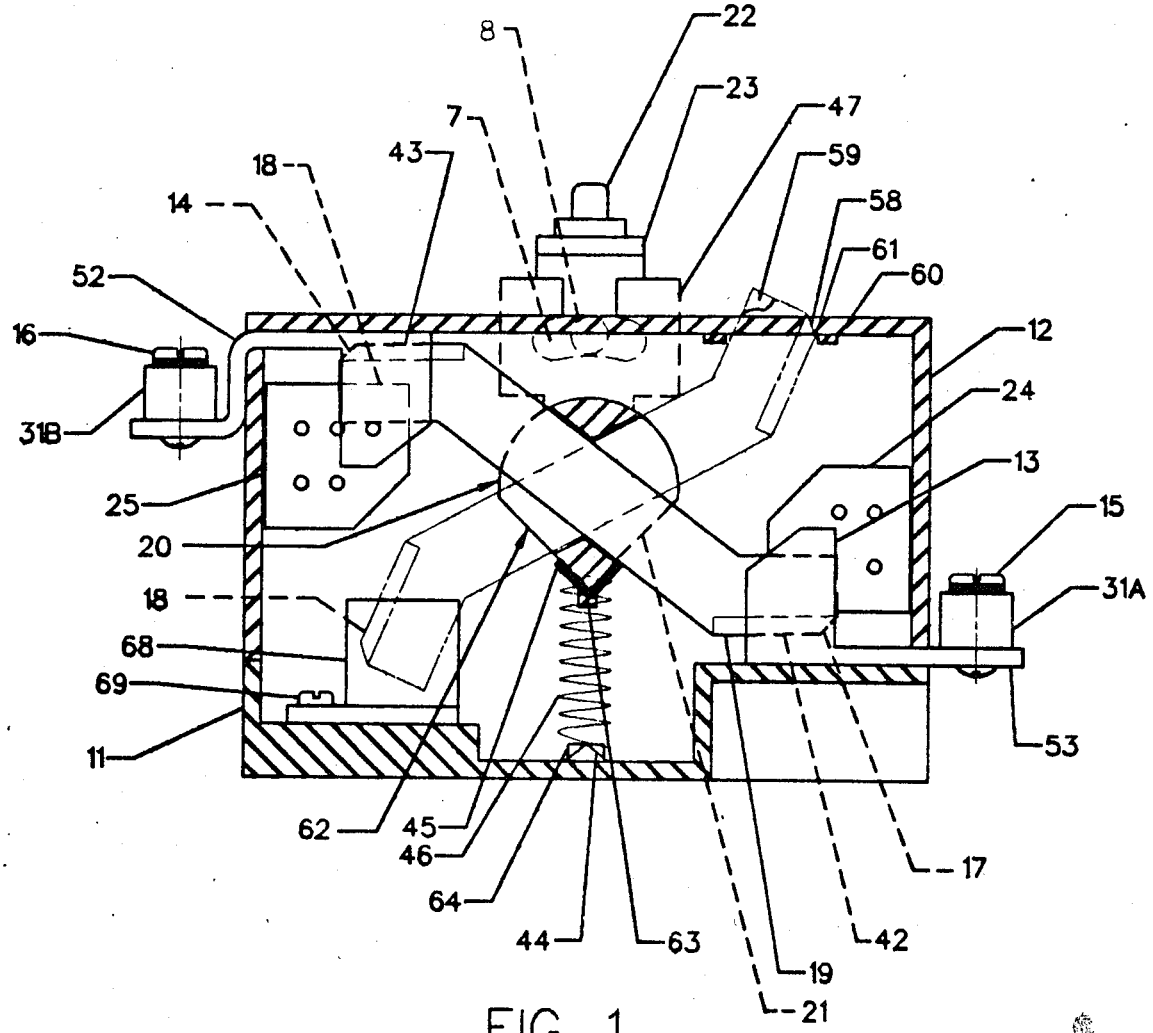
FIG. 1 is a side view of the electrical safety switch according to the invention.

An electrical disconnect or safety switch 10 is shown in FIG. 1 and consists of a molded plastic base 11 to which a molded plastic cover 12 is attached by means of rivets or screws (not shown). A pair of line contact stabs 13 and load contact stabs 14 are attached to the cover and base respectively on opposite sides of a Z-shaped contact blade 19. The line stab is connected within an electrical distribution circuit by means of the line terminal screw 15 and the load stab 14 is connected by means of the load terminal screw 16 arranged on the line and load lugs 31A, 31B. The contact blade 19 is formed into an offset line contact 17 at one end and an offset load contact 18 at an opposite end thereof. The contact blade is carried by a rotor assembly 20, which is pivotally arranged between the base and the cover and which includes a molded plastic split-cylinder 21, which will be described below in greater detail. The contacts are separated from the stabs by an externally accessible operating handle 22, which connects with the rotor assembly by means of a handle yoke 23. A unitary line arc chute 24 is attached to the base adjacent the line stab 13 and a corresponding load arc chute 25 is attached to the cover adjacent the load stab 14, as indicated. The contact blade 19 is indicated in phantom in its "OPEN" position wherein the load contact extends through an indicating slot 58 formed in the top of the cover and contains an indicia coding 59 in the form of a high temperature paint to give positive indication to the operator that the contact has become separated. A healable pad 60 of a latex or soft plastic material such as polymerized polyvinyl alcohol or polyvinyl chloride is adhesibly attached to the inside flat surface of the cover to provide a dust free environment while allowing the load contact to pass through the indicating slot, as depicted. An undersized slot 61 is formed through the healable pad such that when the load contact is moved again to the closed position, the slot closes by virtue of the plastic memory properties of the healable pad. A retainer stab 68, attached to the bottom of base 11 by means of a screw 69, receives and positions the load contact 18 when the line contact in its open position extends out-side the cover. The split-cylinder 21 comprising the rotor assembly 20 includes a conical extension 62 integrally formed therein, which terminates at a stub or post 63 which supports the end of a compression spring 46. A metal triangular pivot plate 45 is arranged over the conical extension to add wear resistance properties to the split-cylinder and the spring support post 63 extends through the pivot plate. A corresponding pivot plate 44 is fastened to the bottom of base 11 to provide wear resistance properties to the spring post 64 integrally formed in the bottom of the base. A pair of T-shaped slotted metal actuators 47, 48, best seen in FIG. 2, are arranged on both sides of the base and cover to allow the operating handle and handle yoke to operatively connect with the rotor assembly by means of pins 8 extending from the handle yoke and captured within slots 7 formed within the actuator.

Figure 2:
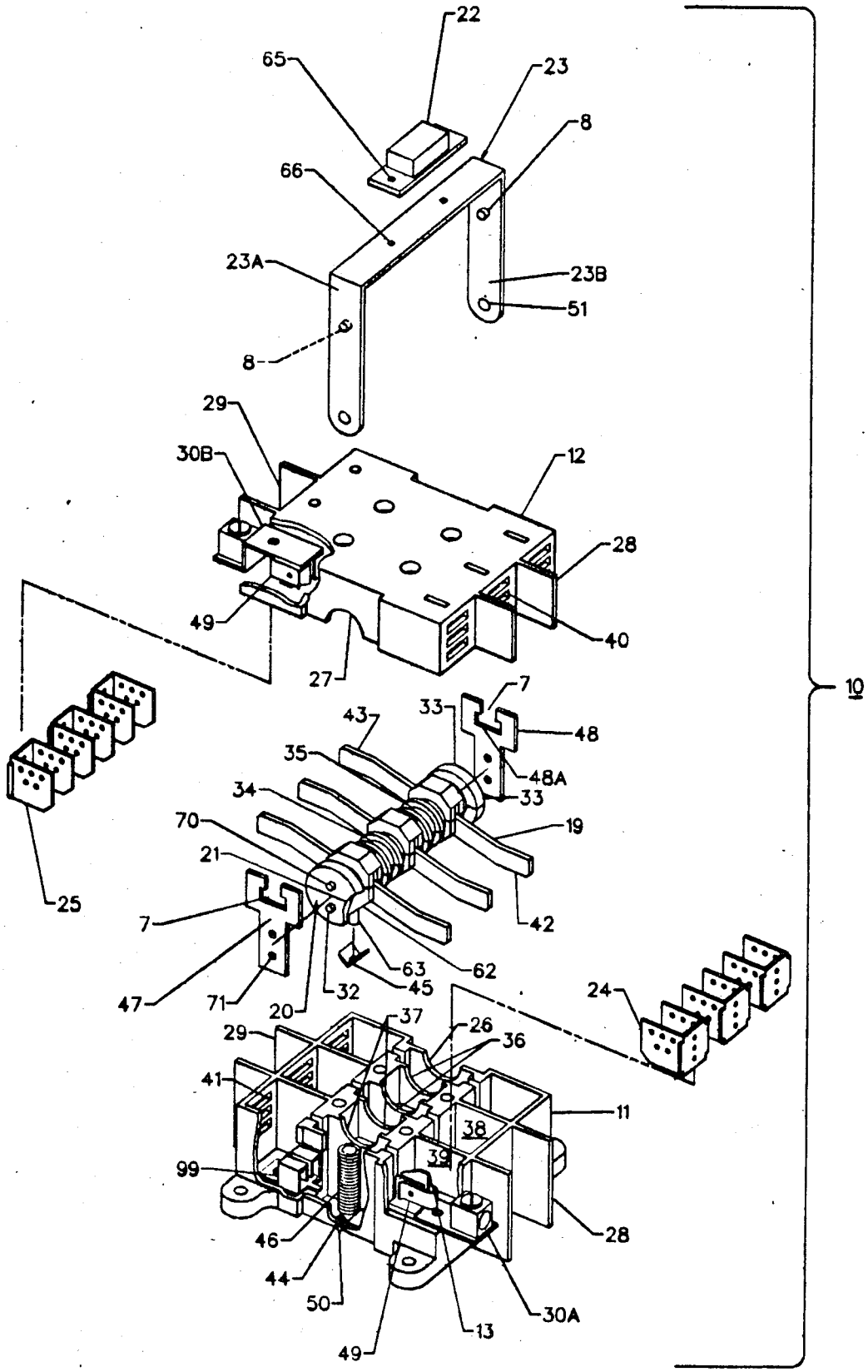
FIG. 2 is a top perspective view, in isometric projection, of the components within the electrical safety switch of FIG. 1.

The assembly of the components which comprise the electrical switch 10 are depicted in FIG. 2 and are arranged for robotically down-loading in an automated assembly process. Both the base 11 and cover 12 are formed from an injection molding process whereby load terminal baffles 29 extend from the load end of the base and cover while corresponding line baffles 28 extend from the line end thereof for electrically insulating the line and load straps 30A, 30B carried by the base and cover respectively. Partitions 38, 39 formed within the base separate the three phase components contained therein and semi-circular slots 26, 27 formed in the opposing side walls of the base and cover support the ends of the split-cylinder 21 while semi-circular slots 36, 37 formed within the partitions support the midsection of the split-cylinder by means of the collars 34, 35 integrally formed within the split-cylinder. The line arc chutes 24 are fastened to an end wall of the base and a plurality of line arc chute vents 40 are formed through an end wall of the cover to provide for the egress of gases formed when arcs occur during the contact connection and separation process. A corresponding plurality of load arc chutes 25 are fastened to an end wall of the cover and a corresponding plurality of load arc chute vents 40 are formed through an end wall of the base to provide for the egress of arc gases. To ensure good electrical contact between the contacts and the contact stabs, a spring clip 49 is positioned across the line contact stab 13. A similar spring clip is arranged across the load contact stab, although not shown. The spring clips are similar to those described within U.S. Pat. No. 4,201,439, entitled "Meter Jaw And Spring Clip Assembly", which patent is incorporated herein for purposes of reference. The triangular pivot plates 44 are inserted over the spring posts 64 (FIG. 1) integrally formed in the bottom of the base and the compression springs 46 are inserted between the corresponding pivot plates 45 positioned over the depending conical extensions 62 formed on the bottom of the split-cylinder 21. When the split-cylinder is arranged on the base 11, the circular protrusions 32, 33 integrally formed at the ends of the cylinder close off the semicircular slots 26, 27 formed in the cover and the base to prevent the admittance of dust or other contaminants. The T-shaped slotted mechanical actuators 47, 48 are fastened to the ends of the split-cylinder by means of pins 70 and holes 71. The handle yoke side arms 23A, 23B are arranged on both sides of the cover and base and the pins 8 on the yoke are inserted within the slots 7 formed within the actuators. The handle yoke 23 is pivotally attached to the base by fitting the pair of apertures 51 formed at the bottom of the yoke side arms 23A, 23B over corresponding posts 50 formed on the opposite sides of the base. The cover 12 is then positioned over the base and the handle 49 is fastened to the yoke by means of holes 65, 66 through the handle and yoke and rivets or screws (not shown).

Figure 3:
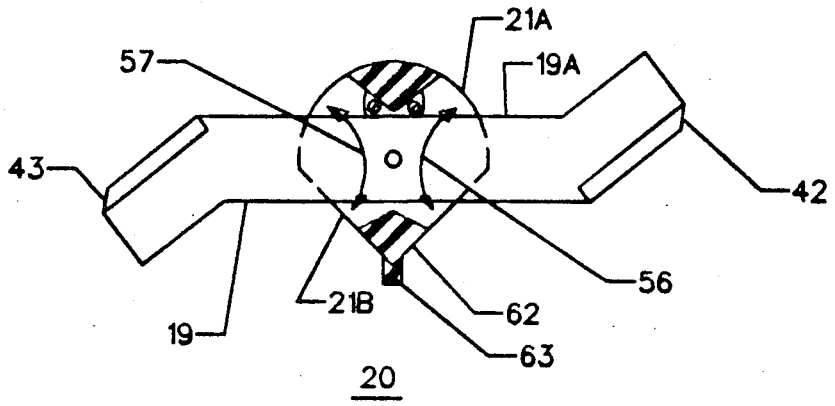
FIG. 3 is a cross-sectional view of the contact carrier employed within the electrical safety switch of FIG. 1.

As shown in FIG. 3, the split-cylinder 21 is formed of a top half 21A and a bottom half 21B adhesively attached together and defining a load gap 57 on one side and a line gap 56 formed in an opposite side. The top and bottom halves can also be attached by ultrasonic welding, screws or rivets. This allows the contact blade 19 to rotate between a pair of angles $\theta$ between 30 and 60 degrees defined between the top half of the cylinder 21A and the top surface 19A of the contact blade before the contact blade 19 strikes the top or bottom of the split-cylinder 21. The arrangement of gaps 56, 57 within the cylinder is an important part of the instant invention. This allows the contact blade 19 to remain stationary while the split-cylinder 21 is rotated carrying the conical extension 62 and posts 63 to either side of center before the contacts 42, 43 are connected or disconnected from their corresponding stabs.

Figure 4:
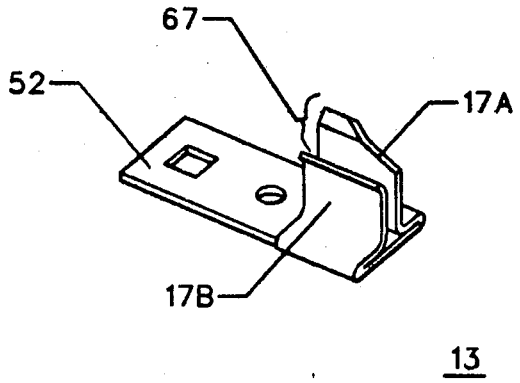
FIG. 4 is a top perspective view of the contact stab employed within the electrical safety switch of FIG. 1.

As described earlier, the line and line and load contact stabs exert reduced electromagnetic attractive forces on the line and load contacts during the connecting and disconnecting processes. The line stab 13, for example, is depicted in FIG. 4 to illustrate the line terminal plate 52, which is integrally formed into a pair of parallel side arms 17A, 17B wherein the line stab 17B is "staggered" or smaller than the line stab 17A. The distance between the side arms defines a sizable magnetic air gap 67 to substantially reduce the electromagnetic interaction caused by the transport of current through side arms which would otherwise produce a strong magnetic attractive force on the associated contact.

Figure 5A:
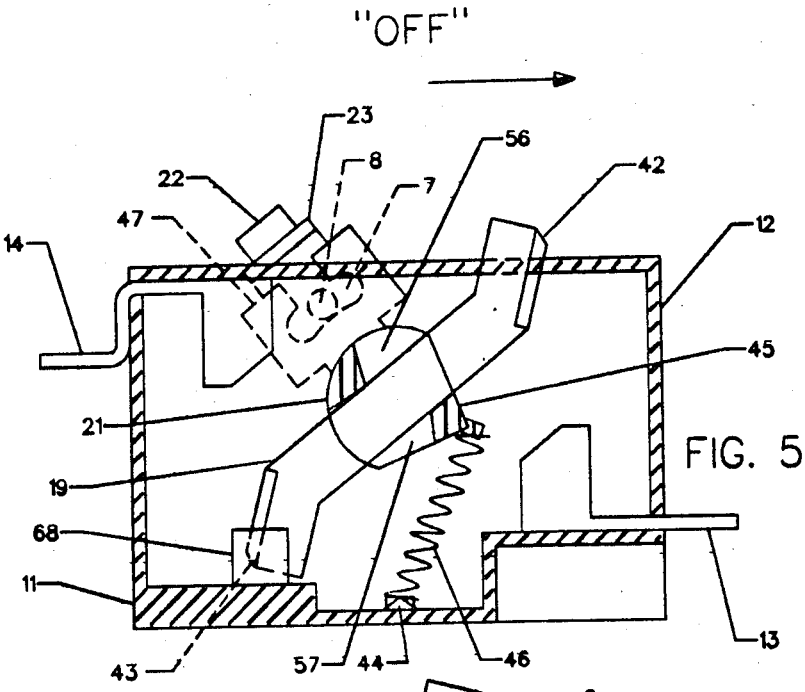
FIGS. 5A–5C are side views, in partial section, of the electrical safety switch according to the invention illustrating the components therein progressing from a contact-closed to a contact-opened position.
Figure 5B:
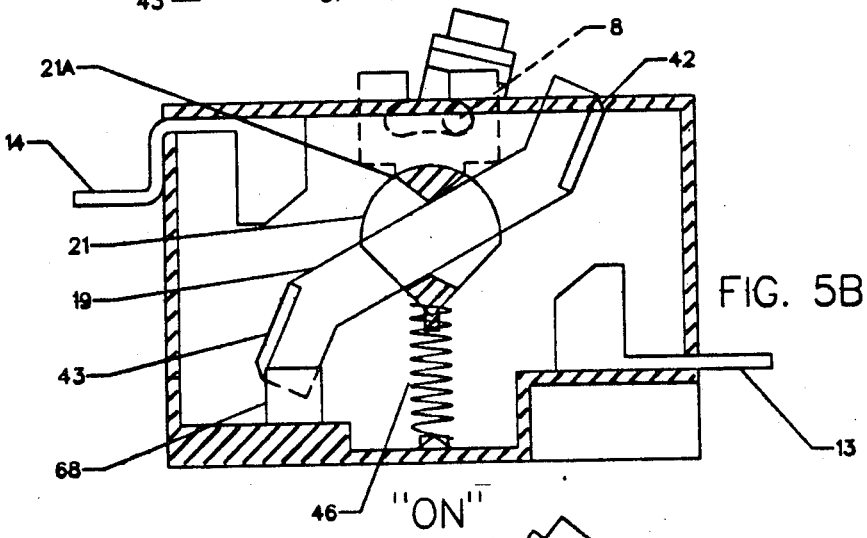
Figure 5C:
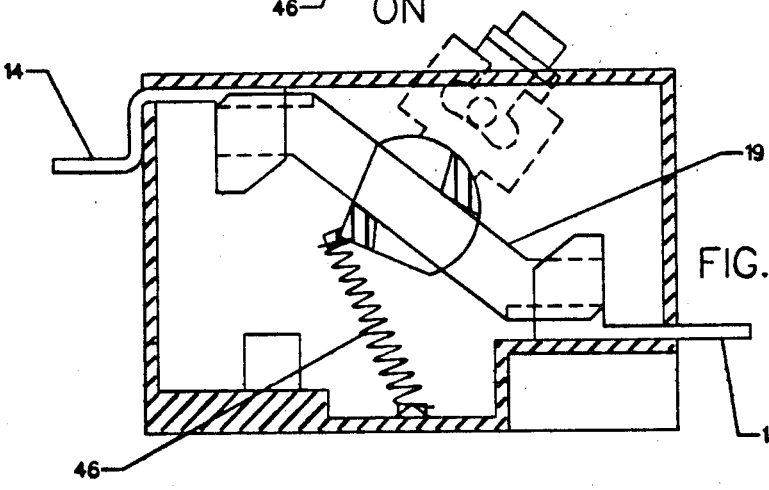

The lost motion provided by the line and load gaps 56, 57 formed within the split-cylinder 21 are depicted in FIGS. 5A–5C to show the movement of the split-cylinder 21 independent of the contact blade 19 with the contacts 42, 43 disconnected from the corresponding line and load stabs 13, 14 and with the operating handle 22 in the "OFF" position, as indicated. Pin 8 attached to both arms of the handle yoke 23 acts as a cam follower within the cam defined by the slot 7 arranged within the mechanical actuator 47. To move the contact blade 19 from the OFF to the ON position, the handle is moved in the indicated direction, which moves the yoke pin 8 within the actuator slot 7, as depicted in FIG. 5B, to rotate the split-cylinder 21 and to bring the compression spring 46 over top dead center before the top 21A of the split-cylinder strikes against the contact blade, driving the contact blade clockwise under the force provided by the compression spring 46 and rapidly driving the contacts 42, 43 within the corresponding stabs 13, 14 as indicated in FIG. 5C. The retainer stab 68 prevents the contact contained therein from moving until the compression springs have moved overcenter. The rapid connection between the contacts and the stabs substantially reduces the duration and intensity of the arc formed prior to connection to thereby allow the use of arc chutes which are reduced in size.

Figure 6A:
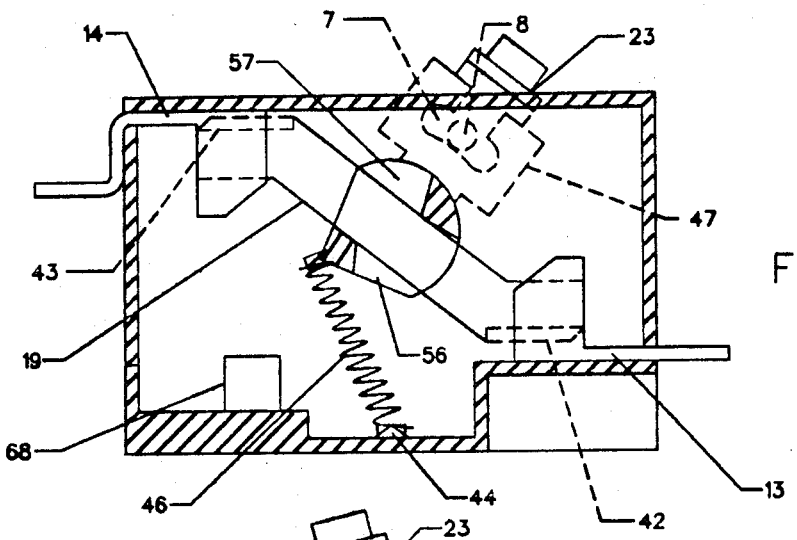
FIGS. 6A–6C are end views, in partial section, illustrating the components of the electrical safety switch according to the invention from a contact-closed to a contact-opened position.
Figure 6B:
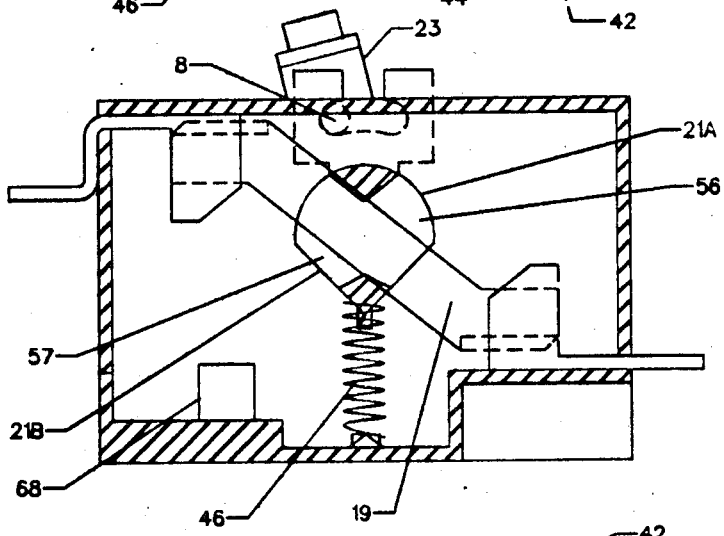
Figure 6C:
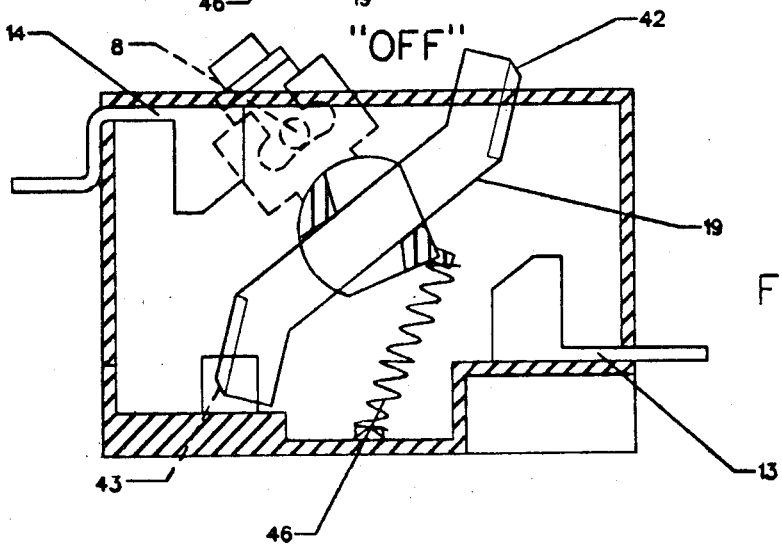

The disconnection between the contacts 42, 43 and the stabs 13, 14 is depicted in FIGS. 6A–6C as follows. Movement of the operating handle 49 and the handle yoke 23 in the indicated direction moves the pin 8 on the handle yoke within the slot 7 within the mechanical actuator 47 until the pin strikes the edge of the slot, causing the split-cylinder 21 to rotate in the counterclockwise direction as shown in FIG. 6B and moving the compression spring 46 to its top dead center position. Continued movement of the handle then drives the top 21A of the split-cylinder against the contact blade 19 while the compression spring 46 is fully charged to thereby drive the contact blade and the attached contacts 42, 43 rapidly out from electrical connection with the corresponding stabs 13, 14, as indicated in the ON position depicted in FIG. 6C. The lost motion provided by the arrangement of the handle yoke pin 8 and the mechanical actuator slot 7 combines with the additional lost motion provided by the line and load gaps 56 and 57 to ensure that the contact blade 19 does not move the attached contacts 42, 43 in or out of electrical connection with the corresponding stabs 13, 14 until the compression spring 46 has reached its top dead center or its "charged" condition. The retainers 68, as described earlier, hold the load contacts until the contact blade 19 begins motion.

It has thus been shown that an electrical disconnect or safety switch can be automatically assembled within a base and cover of reduced size by the electrical series arrangement of a double ended contact blade and a pair of contact stabs. Rapid connection and disconnection by means of an overcenter charged compression spring substantially reduces the arc duration which occurs between the contacts and the stabs during the connection and disconnection process.

Having thus described our invention, what we claim as new and desire to secure by Letters Patent is:

1. An electric safety switch comprising:

a cover and a base;

a rotary contact blade carrier connected with an operating handle and arranged within said cover and said base and supported by side walls integrally formed with said base;

a double-ended contact blade on said rotary contact blade carrier and having a first contact on one end and a second contact on an opposite end;

a first contact stab receiving said first contact and a first arc chute mounted on said cover;

a second contact stab receiving said second contact and a second arc chute mounted on said base; and an overcenter spring mounted between said rotary contact blade carrier and a bottom of said base for driving said first and second contacts into and out of electrical connection with said first and second contact stabs.

2. The electric safety switch of claim 1 wherein said rotary contact carrier comprises a molded plastic split-cylinder having a first half joined to a second half and defining a first predetermined gap between said first half and said second half of said split-cylinder, said first predetermined gap providing first lost motion to said rotary contact blade carrier to charge said overcenter spring in a first direction before said first half of said split-cylinder strikes said contact blade to move said first and second contacts in and out of electrical connection with said first and second contact stabs under the force provided by said charged overcenter spring.

3. The electric safety switch of claim 2 including a second predetermined gap between said first half and said second half of said split-cylinder, said second predetermined gap providing second lost motion to said rotary contact carrier to charge said overcenter spring in a second direction before said second half of said split-cylinder strikes said contact blade to move said first and second contacts into and out of electrical connection with said first and second contact stabs under force provided by said charged overcenter spring.

4. The electric safety switch of claim 1 wherein said split-cylinder includes a first projection integrally formed on an outer surface and retaining one end of said overcenter spring.

5. The electric safety switch of claim 4 further including a second projection formed on an inner surface of said base and retaining an opposite end of said overcenter spring.

6. The electric safety switch of claim 5 wherein said overcenter spring comprises a compression spring.

7. The electric safety switch of claim 2 wherein said first half forms an angle of from 30 to 60 degrees with a top surface of said contact blade.

8. The electric safety switch of claim 1 wherein said first and second arc chutes each comprise a unitary U-shaped piece of metal.

9. The electric safety switch of claim 1 further including a slot through a top of said cover, one of said first and second contacts being arranged subjacent said slot for passage through said slot when said one contact is separated from said corresponding contact stab.

10. The electric safety switch of claim 1 wherein said operating handle connects with said contact blade carrier by means of a handle yoke.

11. The electric safety switch of claim 10 including a slotted T-shaped actuator attached at an end to said split-cylinder and movably attached at an opposite end to said handle yoke.

12. The electric safety switch of claim 11 including means on said handle yoke extending within a slot on said T-shaped actuator, said slot providing lost motion between said handle yoke and said split-cylinder.

13. The electric safety switch of claim 1 wherein said first and second contact stabs each comprise a unitary metal piece formed into a U-shaped end and a planar support.

14. The electric safety switch of claim 13 wherein said contact stab U-shaped end comprises a pair of legs extending from said planar support, an end of one of said legs extending further than a corresponding end on the other of said legs thereby defining an extended magnetic air gap between said pair of legs.

15. The electric safety switch of claim 1 wherein said first and second halves of said split-cylinder each comprise a triangular cross-section.

16. The electric safety switch of claim 10 wherein said handle yoke attaches to said base by insertion means integrally formed on an exterior of said base within a corresponding pair of holes formed through one end of said handle yoke.

* * * * *